US006880892B2

(12) United States Patent
Danino Inchaustegui

(10) Patent No.: US 6,880,892 B2
(45) Date of Patent: Apr. 19, 2005

(54) SEATING MEANS WITH PRESSURE AND FLOTATION CONTROL

(76) Inventor: Rafael Danino Inchaustegui, Av. Pedro Venturo No. 313, Santiago de Surco, Lima (PE)

( * ) Notice: Subject to any disclaimer, the term of this patent is extended or adjusted under 35 U.S.C. 154(b) by 0 days.

(21) Appl. No.: 10/447,499

(22) Filed: May 28, 2003

(65) Prior Publication Data

US 2004/0239171 A1 Dec. 2, 2004

(51) Int. Cl.[7] ..... A47C 27/10
(52) U.S. Cl. ..... 297/452.41
(58) Field of Search ..... 297/284.6, 452.41, 297/DIG. 3, DIG. 8; 5/685, 654, 655.5, 713

(56) References Cited

U.S. PATENT DOCUMENTS 4,354,289 A * 10/1982 Richards et al. ..... 5/679
4,370,769 A * 2/1983 Herzig et al. ..... 5/654
4,738,486 A * 4/1988 Surber ..... 297/452.41
4,761,011 A * 8/1988 Sereboff ..... 297/452.41
4,929,026 A * 5/1990 Barbelet ..... 297/452.41
5,259,079 A * 11/1993 Visser et al. ..... 5/685
5,335,968 A * 8/1994 Sheridan et al. ..... 297/250.1
5,444,881 A * 8/1995 Landi et al. ..... 5/708
5,516,188 A * 5/1996 Bruhnke et al. ..... 297/129
5,617,596 A * 4/1997 Boyd ..... 5/683
5,738,406 A * 4/1998 Deus ..... 297/200
5,839,788 A * 11/1998 Orr, III ..... 297/452.41
5,860,705 A 1/1999 Ridder ..... 297/452.41
5,988,747 A * 11/1999 Jeans ..... 297/313
6,036,271 A * 3/2000 Wilkinson et al. ..... 297/452.41
6,206,474 B1 * 3/2001 Kruse et al. ..... 297/452.41
6,223,360 B1 * 5/2001 Lu ..... 4/603
6,404,343 B1 * 6/2002 Andou et al. ..... 340/605

* cited by examiner

*Primary Examiner*—Peter R. Brown
(74) *Attorney, Agent, or Firm*—Milton Oliver, Esq.; Ware Fressola Van Der Sluys & Adolphson LLP

(57) ABSTRACT

A seating means formed by a plurality of support units, each one with two kinds of separate chambers connected by free flow ducts; a main chamber filled with liquid, and empty and larger capacity secondary chamber(s). Each support unit corresponds to a specific contact area of the human body. Only main chambers come into contact with the body of the user, receiving the user's weight pushing through the free flow ducts, towards their respective secondary chambers, a volume of liquid equal to the volume displaced by the weight received and wherein an individual control of pressure and flotation is established due to the shape and position of secondary chambers and the density of the liquid contained. The support units are outfitted with independent filling and drainage valves as well as temperature control and leakage control devices.

8 Claims, 10 Drawing Sheets

SEATING MEANS WITH PRESSURE AND FLOTATION CONTROL

FIELD OF THE INVENTION

The present invention relates generally to a piece of furniture and more specifically to a seating means, which is formed by several compartments filled with liquid. These compartments will allow for diverse kinds of support to the different parts of the human body.

BACKGROUND OF THE INVENTION

Until now many efforts have been developed, through the application of different techniques, to manufacture water cushions and water chairs, in an effort to get a chair providing the best possible comfort for the user, by offering maximum support for the lower part of the back or lumbar area, by minimizing the problem of waves, localized pressure points and the tightness, as well as the problem of bedsores of those patients prostrated or confined to a chair. Although there has been an advance in this kind of furniture, the above mentioned problems have not been properly solved since the current water furniture does not have a control mechanism for the pressure of the liquid contained inside the cushions, to assure that this pressure proportionally corresponds to the pressure that each part of the body exerts. Likewise, it has been not possible to reach a total flotation state.

In effect, until now, the current "water chair" consists of a structure with a cushion or cushions made of elastic or flexible materials, filled with a liquid element. The main idea is that, at the moment of receiving the weight of the user, the liquid contained in the seat cushion flows to the upper part cushion (the back); resulting in the same liquid being distributed between the cushions to support the whole body of the user.

It is true that the techniques developed so far have had some success; however, what has not yet been accomplished is the control of the different support pressures; nor a state of flotation without restraints.

In that way, for instance, we have the Ridder, Barbelet and Surber disclosures, U.S. Pat. Nos. 5,860,705; 4,929,026 and 4,738,486; respectively, which present just one envelope or cushion filled with liquid with two parts: Seat and back. In all these cases, the same principle is used: The seat part, when receiving the weight of the user, displaces the contained liquid towards the back cushion; thus the same liquid supports not only the seat but also the back of the user.

It has to be noted that in these inventions, the flow of liquid from the seat towards the back is not free, but limited or delayed by restriction mechanisms for the passing of the flow. Even though in the above mentioned patent documents it is claimed that the flow restriction mechanisms allow for the control of pressure; actually, such mechanisms only serve to avoid the abrupt changes or the waviness that is produced due to the effects of movement of liquid from one cushion to another, or from the seat towards the back; resulting in the same pressure, not only for the seat but also for the back cushion.

Likewise, the current water chairs are divided into two parts: seat and back; thus most are unable to give individual and controlled support for each main pressure point of the body of the user.

Another disclosure called: "Water cushion stress-reducing for chairs and other seating devices" developed by J. Sereboff, U.S. Pat. No. 4,761,011 refers to a fixed structure, prepared to hold a plurality of cushions horizontally disposed and vertically spaced, which are individually and partially filled with water. Although this invention has tried to give individualized support to different sections of the user's body, it has been unable to control the pressure or pressures for each support point of the body. Furthermore, due to the small volume of liquid used, it has been unable to make the user float comfortably on the chair.

SUMMARY OF THE INVENTION

The present invention, due to its particular structure and system, is different from the existing ones because it eliminates the problems described above. It provides at all times, not only adequate support for the different support points of the human body thanks to the individual control of the pressures reached; but also a state of total flotation.

One object of the current invention is to provide a seating means with a liquid as the supporting element, where the firmness of the cushions or the chambers receiving the weight of a person, is differentiated with respect to the different areas of support of the user's body. In that way, the maximum comfort and contact is sought, in order to reduce the presence of pressure points which can affect some body parts of the user more than others.

Another object of this invention is, besides providing a good support for each part of the human body (head, nape, lower part of the back, arms, calves, heels, etc.), to also avoid the waviness problem, which to a greater or lesser extent, is common among the existing water chairs due to the movement of liquid from one cushion to another or from the seat to the back.

In this case, the present invention refers to a seating means made of a furniture structure prepared to receive and to hold a plurality of support units, each one formed by two kinds of separate chambers: a main chamber completely filled with liquid; and secondary chamber(s) completely empty. Each support unit corresponds to a different support area of the human body.

Support units are horizontally oriented and fixed to a furniture structure through constraining and positioning devices.

The number of support units is variable so that the following support points of a person using it are covered: head, nape, back, lumbar area, buttocks, legs, calves and heels, apart from the arms and hands.

The structure has a movable support area for the calves and heels. It can vary or regulate its position according to the requirements of the user, from a vertical down position up to horizontal, through the use of a manual or motorized mechanical device. The structure also has a resting part for the arms.

The furniture structure can be made of wood, metal, plastic or a combination of these elements. However, it must be stronger than conventional furniture pieces, because it has to support both the weight of an intended user plus the weight of the total amount of liquid contained which is, in the standard version of the present invention around 255 kilos, allowing for intended users in an weight range estimated of 0 to about 170 kilos.

Considering the flotation is given according to the volume and the weight of liquid displaced by the weight of the user, the present invention is able to give perfect support and flotation to users that weigh less than 170 kilos. Despite the generous amount of liquid contained in the chambers, the user will only displace the amount corresponding to its weight.

In the case of heavier users, special designs must allow for the weight of the liquid to be approximately 150% of the weight of the user in order to give them adequate support and flotation, i.e., for users weighing 200 kilos, the amount of liquid must be increased to approximately 300 kilos.

The structure must have appropriate angles of inclination, not only for the seat but also for the back, in order to achieve maximum contact area with the body of the user, thus reducing the number of pressure points.

The structure is outfitted with casters in order to make it easier to move around.

As already mentioned, the seating means, which is the subject-matter of the present invention, has several support units which are affixed to the structure. These particular support units are each formed as follows:

a) One main chamber made of a flexible, extensible and elastic waterproof material, which size and shape varies according to the weight of the part of the human body to be supported.

b) Secondary chambers of a predetermined shape and with an at least 10% bigger volume and capacity than the main chamber they serve. Each secondary chamber presents two components: a) An inner body, made out of a collapsible and elastic waterproof material, which is connected to the main chamber; and, b) an external rigid body of predetermined shape and volume containing the inner body. Secondary chambers may be one, two and even more by each support unit according to specific designs for the furniture structure. The current invention shows support units with one and two secondary chambers c) Free flow ducts, according to the number of secondary chambers connected to the main chamber, made of a non-collapsible waterproof material which connects the main chamber to the secondary one(s), assuring the free flow of the contained liquid from one chamber to another.

d) A liquid substance, i.e., water, treated water, oil, etc.; initially contained in the main chamber and free flow ducts which volume is at least 1.5 times bigger than the volume displaced by the weight of the body it will be supporting.

e) Independent valves for each support unit, located in the upper part of the inner body of secondary chambers so that they can be filled and emptied.

In the present invention, only main chambers are brought into contact with the body of the user, while secondary chambers never touch the user.

Since the volume of the liquid contained in main chambers is bigger than the volume displaced by the weight of an intended user and, since the volume of secondary chambers is bigger than that of main chambers, there are no restrictions upon the flow of liquid from one chamber to another. Likewise, no counter pressure arises due to any limits imposed by the size of chambers, or from the volume of liquid contained therein, allowing the user to float freely.

When there is no user sitting in the seating means, only main chambers and free flow ducts are filled with liquid. The inner bodies of secondary chambers are completely empty and airless. When a person sits down, a volume of liquid contained in the main chambers, equal to the volume displaced by the weight of the user, is moved through the free flow ducts towards the secondary chambers. The secondary chambers, that were initially empty, receive this flow of liquid up to levels predetermined, not only by their shape but also by their position, thus controlling the pressures and flotation which arise from the very first contact of the user with the main chambers (initial pressure), and all through the sequence of intermediate pressures up to the final pressure of resting or flotation.

When a user gets up from the chair, all of the displaced liquid drains from the secondary chambers back to the main chambers and the free flow ducts.

Support pressure and flotation provided by main chambers to the user's body is controlled basically as follows:

a) Relative height of secondary chamber(s) with respect to the corresponding main chamber: The bottom or lower part of the secondary chamber(s) is never placed below the top part of its corresponding main chamber. The higher positioned the secondary chambers are with respect to the main chambers, the bigger the initial pressure will be (more steady, firm support) and lesser the flotation will be, due to the effects of the hydrostatic pressure.

b) Shape of secondary chambers: shape of secondary chambers will determine the sequence of pressures and the flotation that the user's body will receive and will be designed according to the part of the body to be supported by the respective main chamber. A horizontal elongated cross section shape will provide a smooth or soft support, ideal for the head, nape, lumbar, calf and heel areas. A cross section shape formed by a horizontal elongated form with a trapezoid on the top will provide a support starting out soft and then becoming slowly firmer, ideal for the seat and back. Shapes like the vertical elongated form will provide for a firm or hard support; or the "L" version for a support going from an initial soft and then quickly from soft to firm ideal for the hand and arms areas. Other shapes can also be applied.

c) Density of the liquid contained in the main chamber and the ducts of free flow will influence flotation and the reaction time for the flow of the liquid towards secondary chambers.

Since in this case the capacity of the secondary chamber (s) is always larger than the capacity of the corresponding main chambers, as already mentioned above, these secondary chambers will never completely fill up. Even when all the liquid contained in the main chamber is displaced there will always remain a space to be filled in the second chambers. There are no restrictions in the flow of the liquid from one chamber to another, this being totally free. In this way, no effects of counter pressure or wave formation will be produced, although the liquid is contained within the closed space of the main chambers which, when receiving the pressure applied to them, will displace the liquid towards the secondary chambers without filling them up to the limit. However, these effects are present in all other existing inventions, and are caused by energy bouncing back from the walls of the cushion or by the limited size of the empty spaces towards which the liquid is displaced.

In addition to the supporting elements already mentioned, and specifically, but not exclusively, for the arms and hands supporting areas, this invention includes below the base of the corresponding main chambers, an elastic body, i.e., foam, gel. This is in order to assure maximum support effect when the user presses down on them as an aid in getting up, thus maximizing pressure at these points.

Considering that the chambers of the support units can be accidentally punctured or the filling valves be badly closed, and consequently leakage may take place; this invention has a mechanism of protection formed by a tray and an electronic device to detect such leakage.

The tray, made of a waterproof material, is slightly inclined and is placed in the lower part of the furniture piece. Its function is to retain the leakage or filtration within the piece of furniture, thus avoiding further spillage.

Inside this tray at the lowest part there is an electronic device that, detecting the presence of leaking liquids will close a normally open circuit and emit a warning sound.

Tapestry, a slipcover, or another similar material covers the outside of not only the structure, but also of the chambers fastened to it, in order to give the seating means an aesthetically appealing appearance. This outside cover has zippers and other means, which allow for its removal and for the chambers to be cleaned, filled and/or otherwise maintained as needed.

Finally, this invention necessarily includes devices to regulate the temperature of the contained liquid formed by an electric fully grounded and insulated liquid proof heating coil with thermostat setting, similar to those used in waterbeds; and as options, it can include devices for inclination and massages to provide a more complete and agreeable rest.

Among the main advantages of the SEATING MEANS WITH PRESSURE AND FLOTATION CONTROL are the following ones:

a) Allows for individual control of pressures of each support unit; i.e. different pressures and different supports for different parts of the human body. This eliminates the problems of such localized points of pressure and tightness that can be found in other existing pieces of furniture, where the same liquid of the seat is distributed to the back causing an equal pressure to all of the supporting area of the body of the user. This does not happen with this invention. Here the liquid from the main chambers receiving the weight of the person is moved to secondary separate chambers that never come into contact with the body of the user.

b) Obtains a state of flotation due to the large volume of liquid contained in the main chambers and free flow ducts (not found in the existing pieces of furniture which, in spite of using liquid as filling material, do so in small quantities); and the storage capacity of the secondary chambers that are always bigger than the main chambers, so that even though all the liquid be moved toward the secondary chambers, these will never fill up totally, thus avoiding the counter pressure or wave formation by offering no resistance to the passing of liquid from one chamber to another, with the result of causing an effect of flotation.

c) Eliminates the wear of the supporting elements, which means that the support provided will not be damaged due to use, which is what really happens in other conventional pieces of furniture that use supporting elements such as foam or steel springs.

d) May cause considerable impact in favor of the mental and physical health of the user:

Diminishes the suffering of patients, and also has different healing effects.

Offers a bigger contact area with the body of the user, through the use of a liquid filling material, appropriate angles of inclination and a plurality of support units it has, thus creating a better distribution of the weight of the user and the elimination of pressure points and tightness resulting in a 100% anatomic support.

A better distribution of the weight of the body, allows it to rest naturally in a flotation state, without pressure points, i.e. ideal for elderly people or for those suffering from orthopedic and spinal column problems.

Avoids considerably the formation of bedsores in the case of users that have problems with moving around or those with severe burns; or that have to be lying down or confined to a chair for long periods.

The state of controlled flotation coupled to heating controls provides great healing benefits i.e. for the treatment of muscle and other problems arising from bad joints and arthritis.

A flotation state assures a complete relaxation of the body and mind of the user, thus markedly reducing stress.

DETAILED DESCRIPTION OF THE PREFERRED EMBODIMENT

Figure 1:
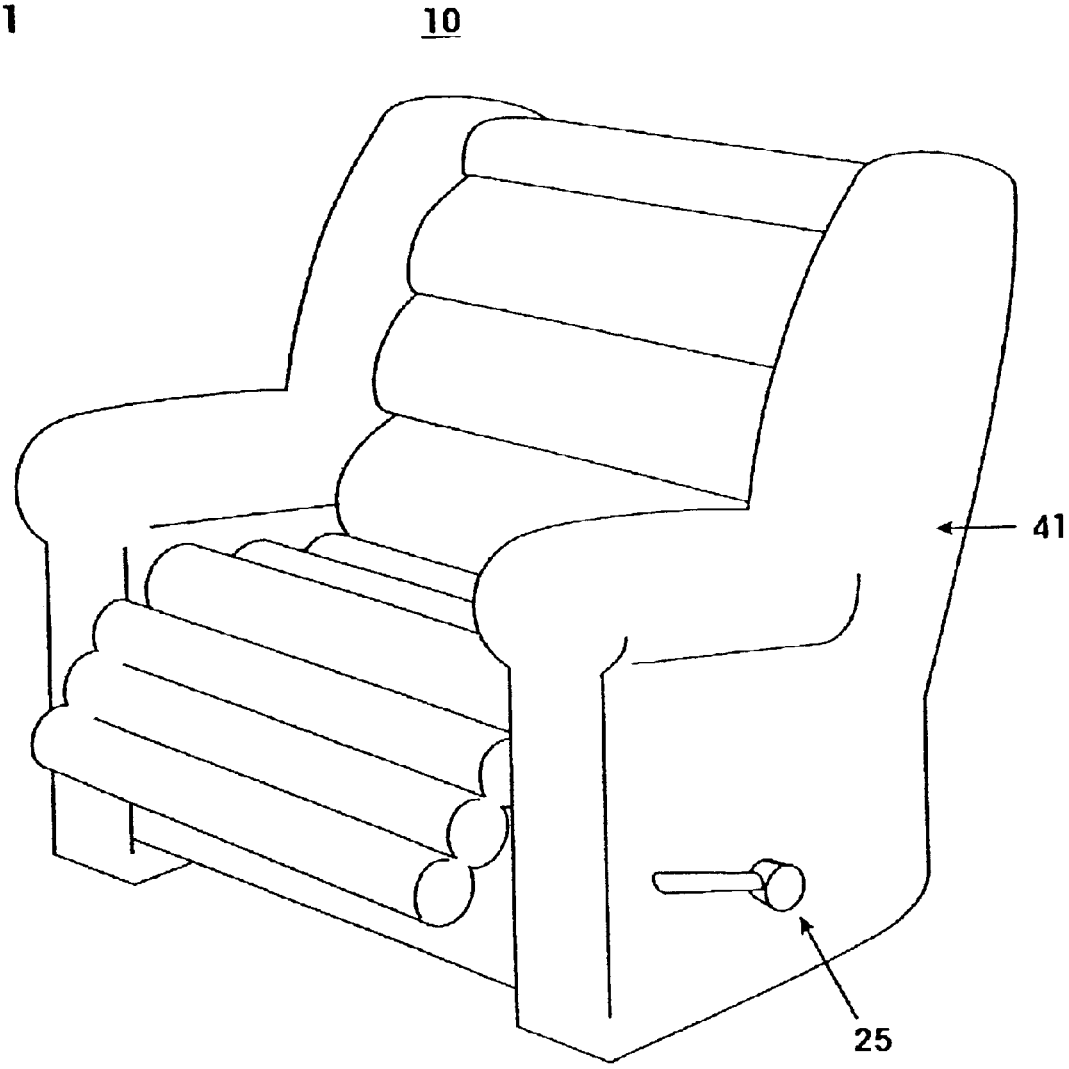
FIG. 1 is an outside view in perspective of a seating means, matter of this invention.

In this case, the reference to the number 10 is assigned to the seating means, which is provided with an structure 11 prepared to receive and hold several support units, each one formed by two kinds of separate chambers: One main chamber 12 completely filled with liquid; and secondary chamber(s) 13 totally empty, where each support units corresponds to a supporting area of the human body: head, nape 14, back 15, lumbar area 16, buttocks 17, legs 18–19, calves 20–21, heels 22, arms 23 and hands 24. See FIGS. 2–6.

Figure 9:
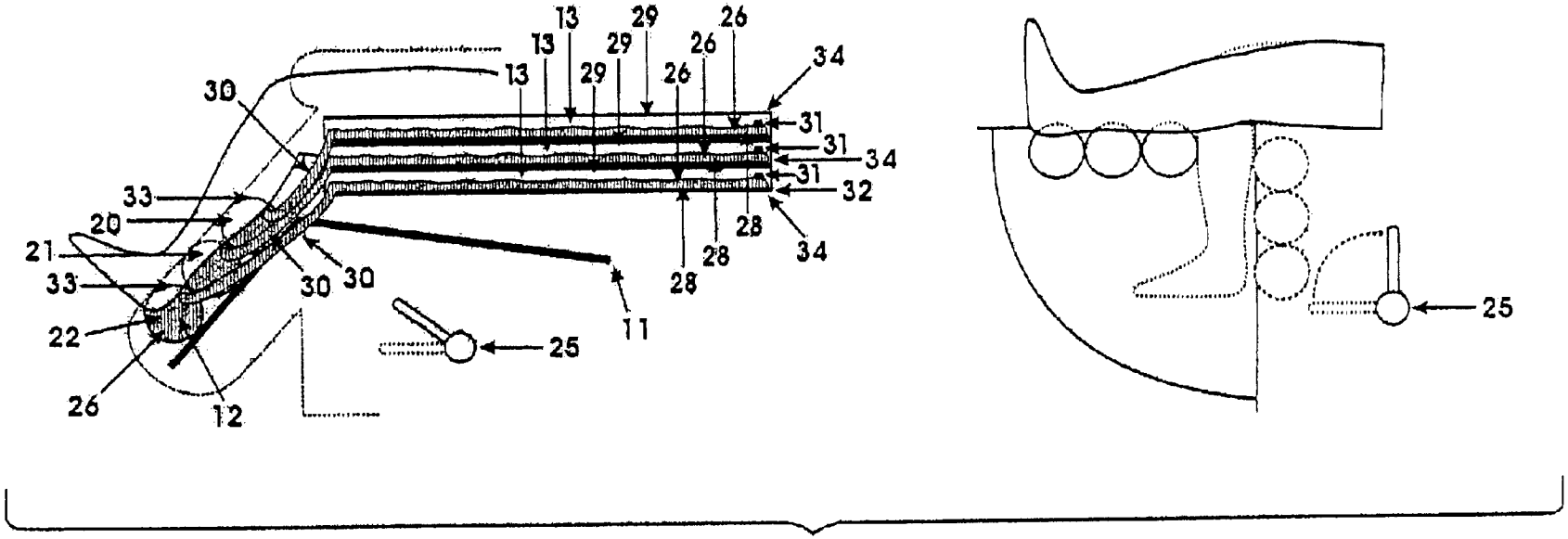
FIG. 9 is a sectional view of a portion of a seating means, corresponding to the calves and heels support areas when in use.

As illustrated clearly in FIG. 9, the support area for the calves 20–21 and heels 22 is movable. Its position can be changed or regulated according to the requirements of a user, from a vertical down position up to horizontal through the use of a mechanical device 25.

The structure 11 of the furniture piece is stronger than conventional pieces of furniture and is ready to support the weight of the user plus the weight of the total amount of liquid contained which for the purpose of the present invention is estimated at approximately 255 kilos, considering an intended user as a person weighing from 0 up to about 170 kilos.

The seating means 10 has casters 27 to allow for easy movement.

The seating means 10 is provided with a plurality of support units, which are affixed to the structure 11. Each support unit is formed by two kinds of chambers: main chamber 12 and secondary chamber(s) 13. Secondary chambers are of a predetermined shape and of a bigger volume and capacity than their respective main chambers 12.

As shown in the FIGS. 3–6, secondary chambers 13 are each made up of two components: One inner 28, collapsible and elastic, which connects with the main chamber 12; and an external rigid body 29, which holds the internal body 28. Main chambers 12 and secondary chambers 13 are interconnected by free flow ducts 30 through which the contained liquid flows freely from one chamber to another. The total volume of the liquid 26 contained in the chambers is selected to weigh 150% of the weight of an intended user—from 0 up about to 170 kilos—which means approximately 255 kilos of liquid.

Each support unit is provided with independent valves 31, placed in the upper part of the internal body 28 of secondary chambers 13, to allow for the filling and emptying of the same.

Figure 7:
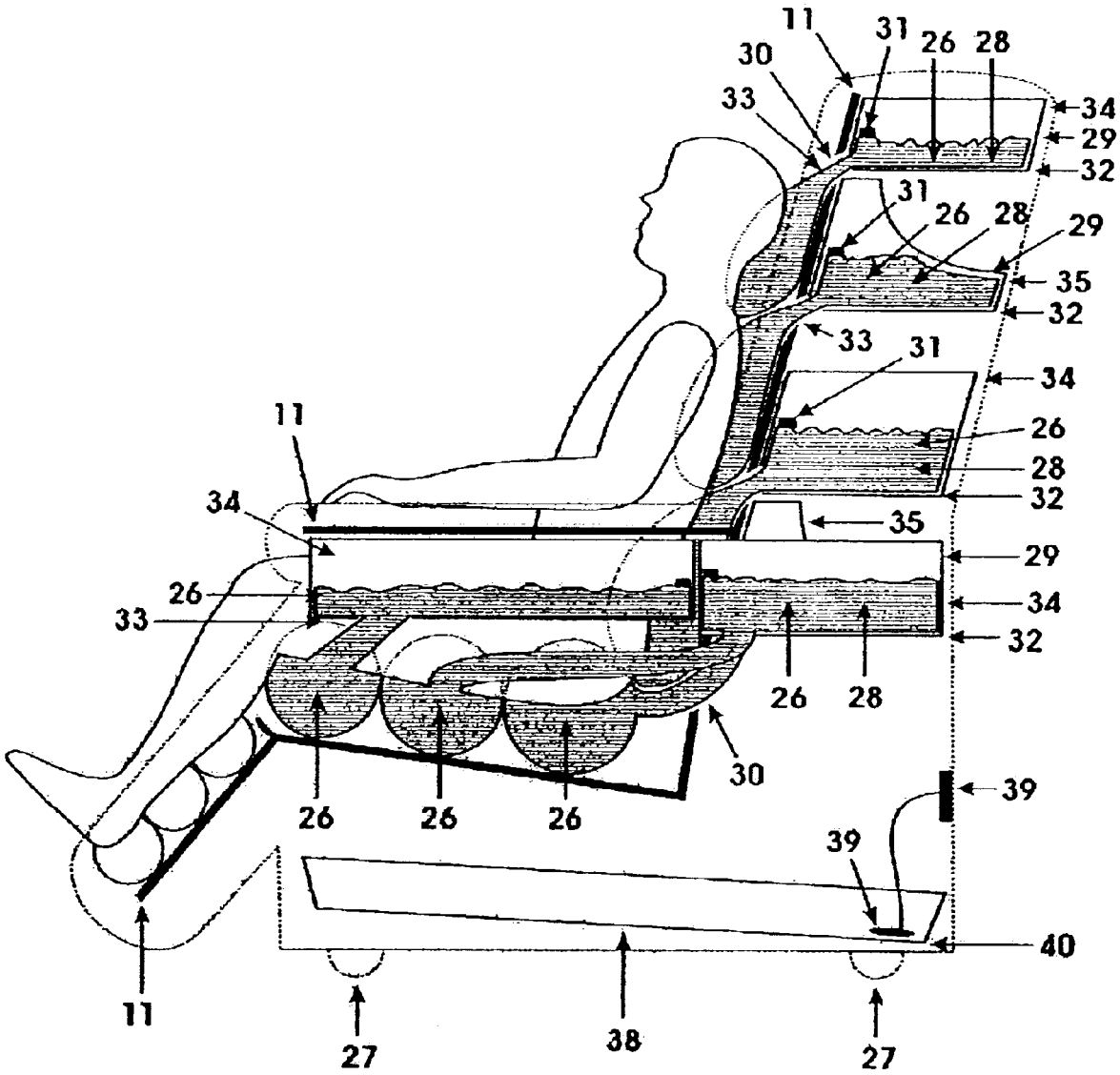
FIG. 7 is a sectional view of a seating means, matter of this invention when in use.

As shown in FIG. 7, only main chambers 12 come into contact with the body of the user, supporting its weight, adapting or molding to its shape, but secondary chambers 13 never come into contact with the body of the user.

Figure 2:
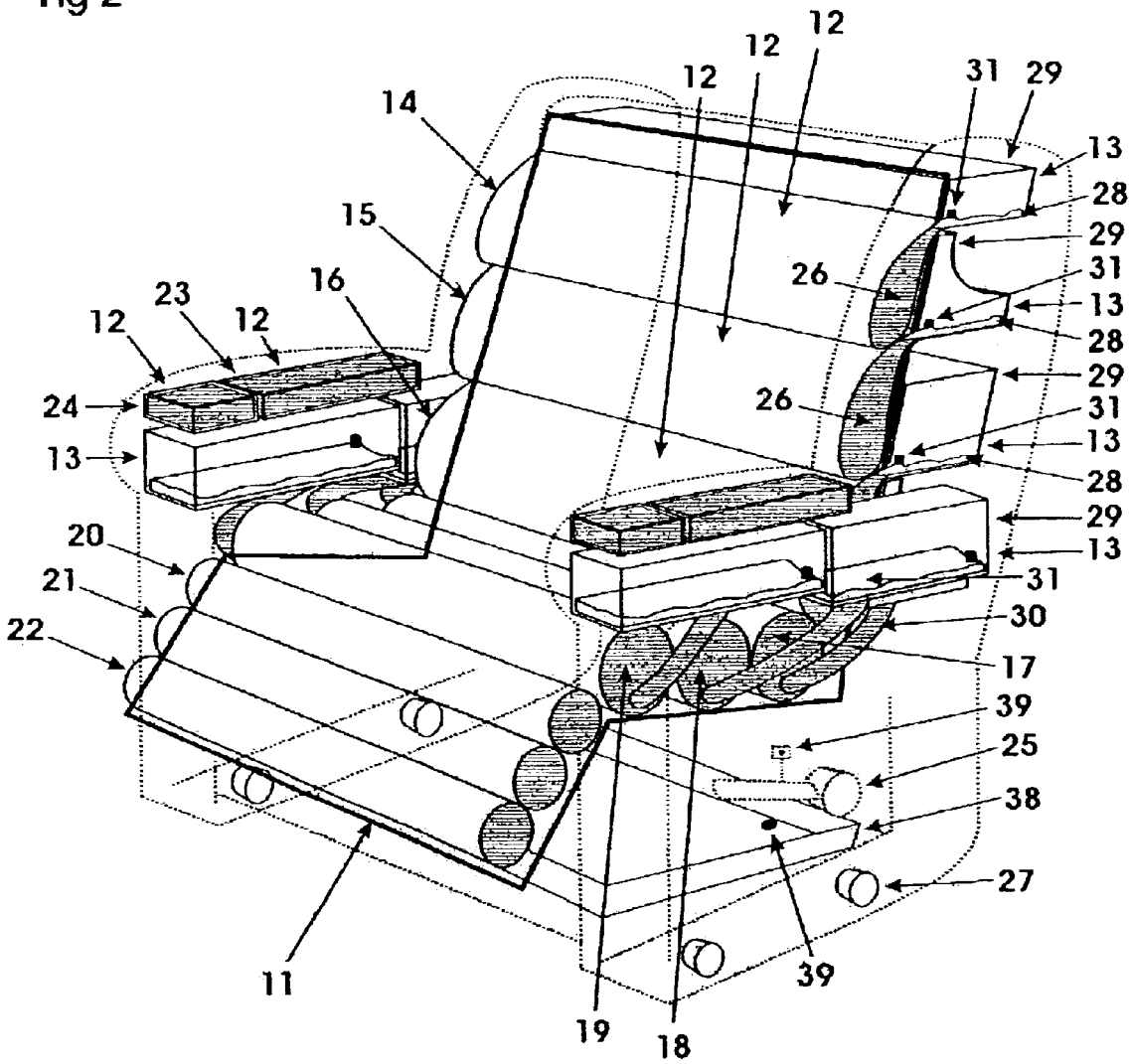
FIG. 2 is a perspective view of a seating means, matter of this invention, which shows the internal structure of the furniture with no one using it.
Figure 3:
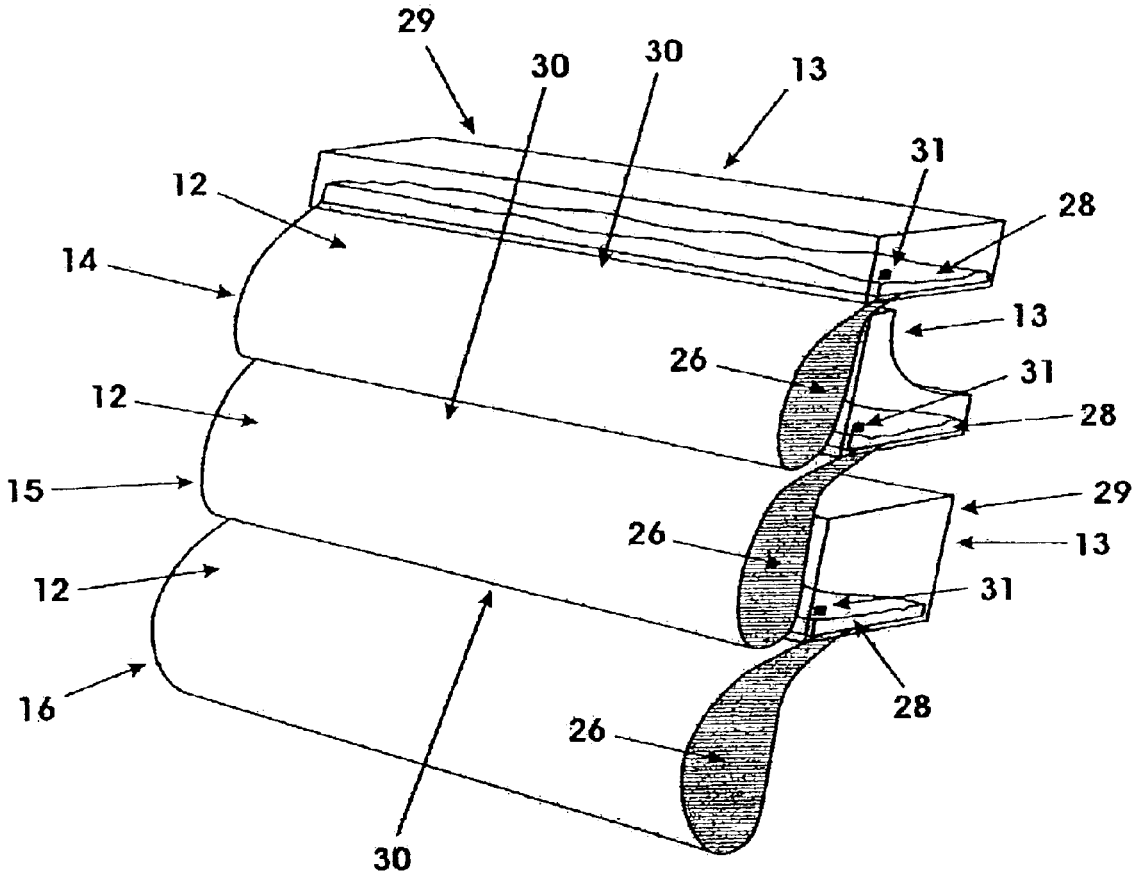
FIG. 3 is an enlarged view of the support units for the head and nape, back and lumbar areas.
Figure 4:
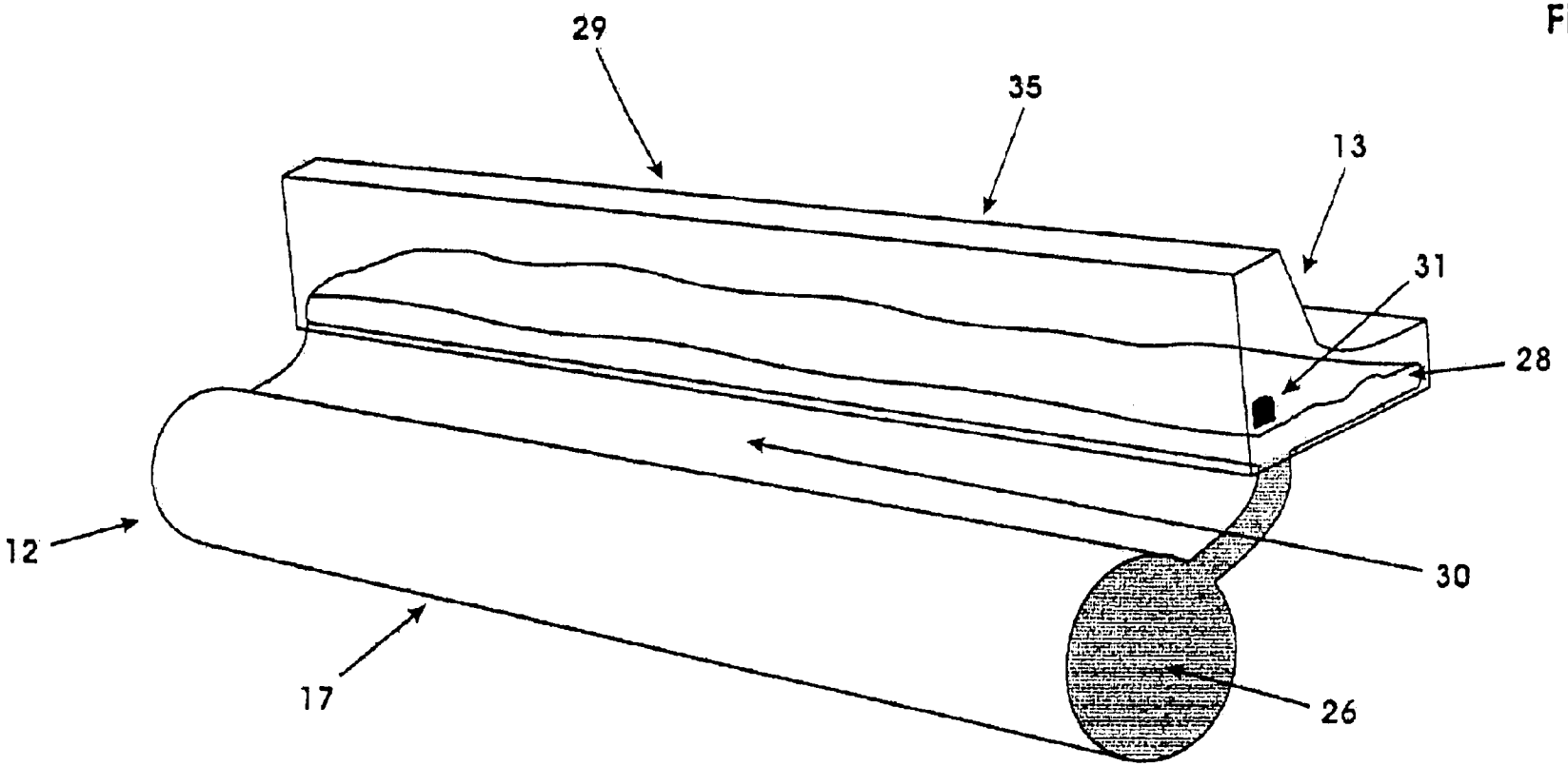
FIG. 4 is an enlarged view of the support units for the buttocks.
Figure 5:
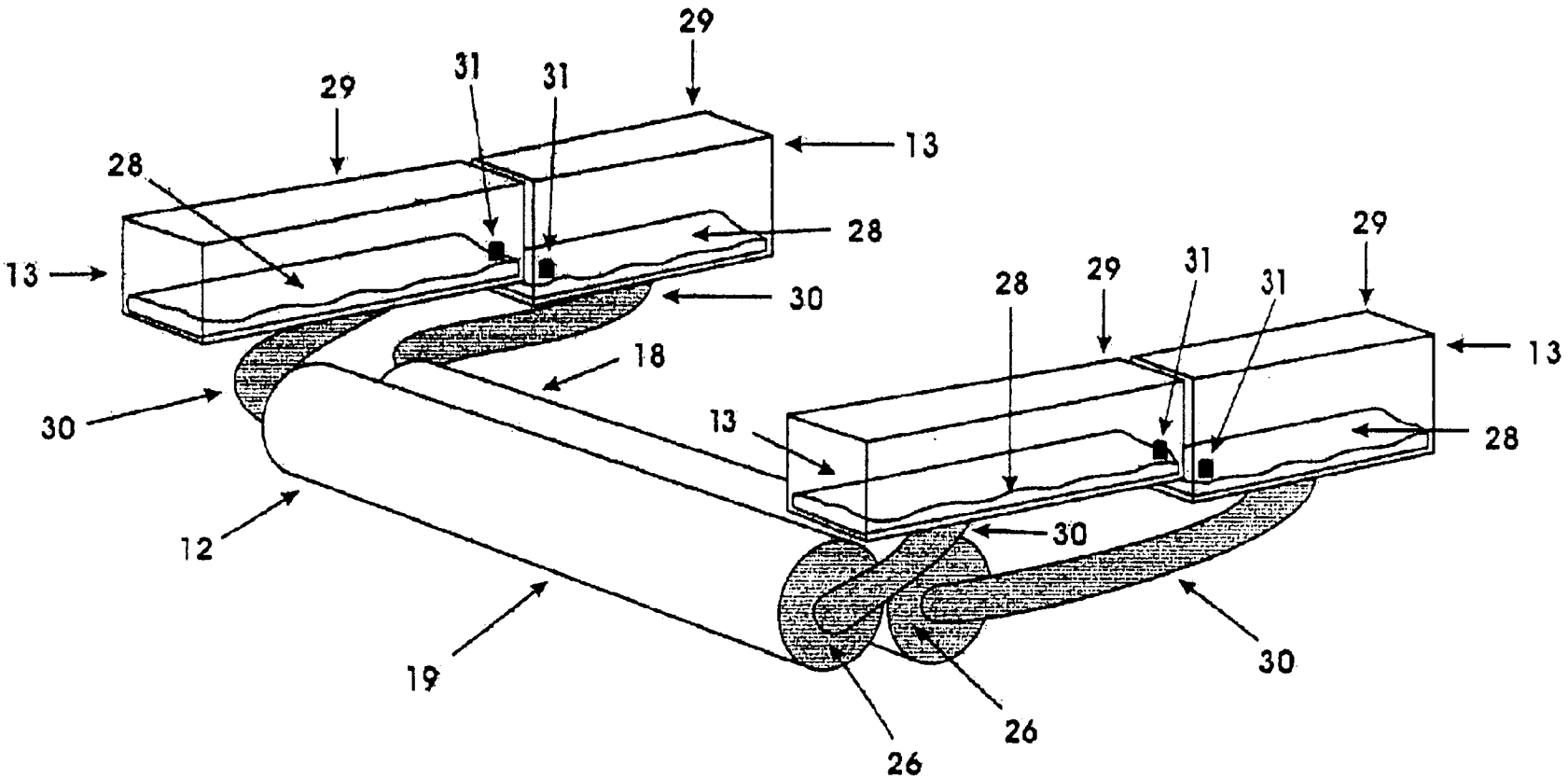
FIG. 5 is an enlarged view of the support units for the legs.
Figure 6:
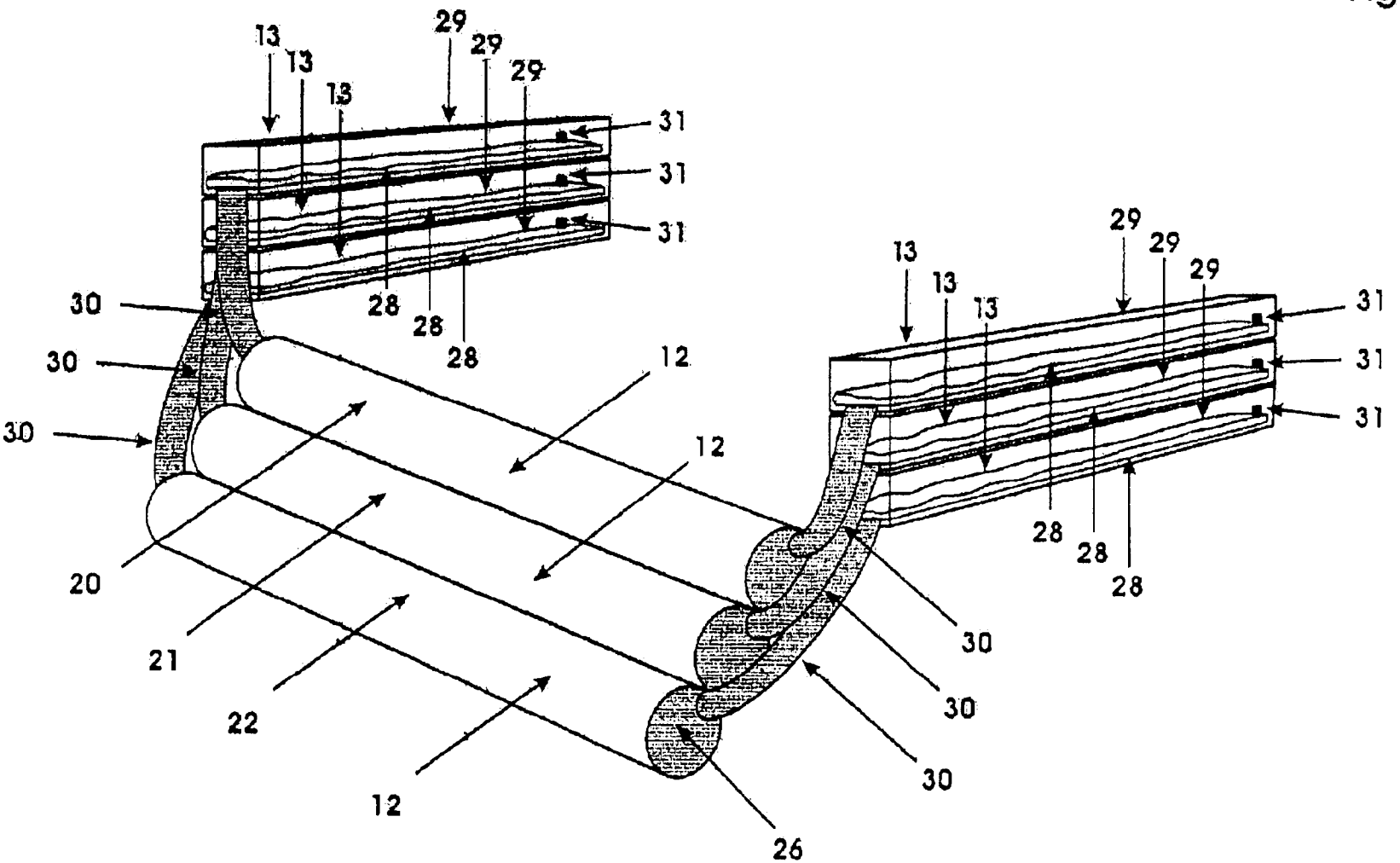
FIG. 6 is an enlarged view of the support units for the calves and heels.
Figure 8:
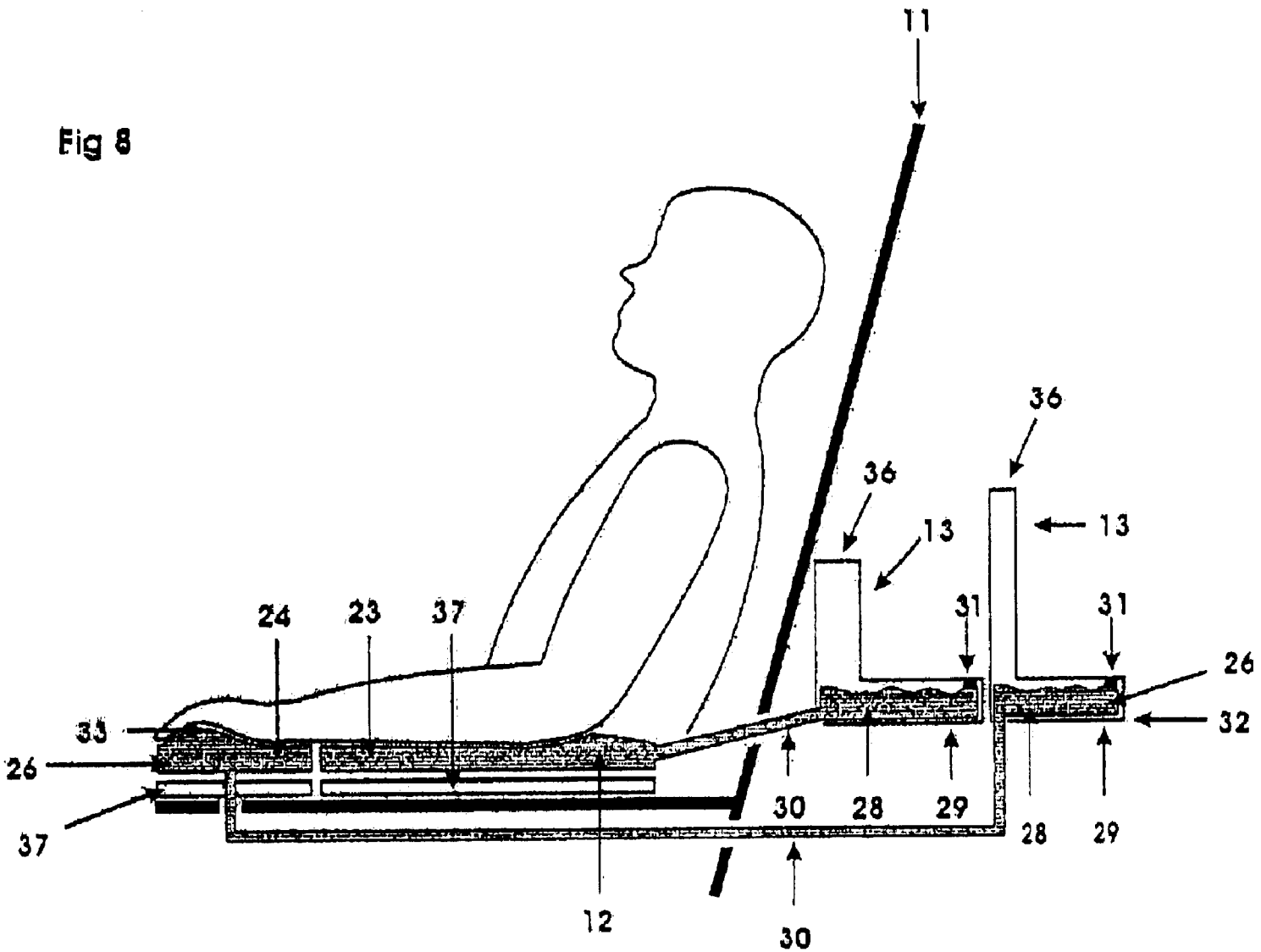
FIG. 8 is a sectional view of a portion of a seating means, corresponding to the arms and hands support areas when in use.

When there is no user occupying the seating means, see FIG. 2, only main chambers 12 and the free flow ducts 30 are filled with liquid 26. The internal body 28 of secondary chambers 13 are completely empty and without air. When a user sits down, as can be seen in the FIGS. 7–9, an amount of liquid 26 contained in the main chambers 12, equal to the displaced volume of the weight they receive, is moved through the free flow ducts 30, towards to the secondary chambers 13. Secondary chambers 13, that were empty, receive this flow of liquid up to the levels predetermined not only by their shape but also by their relative height with regard to its main chamber, thus controlling the pressures and the flotation that are produced from the moment of the first contact of the user with the main chambers (initial pressure), through the sequence of the intermediate pressures up to the final pressure of resting or flotation.

The control elements of pressure and flotation that main chambers 12 provide to the body to be supported are:

a) Relative height of secondary chambers 13 with respect to the corresponding main chamber 12, in order to make use of the hydrostatic pressure. The lower part 32 of the secondary chamber(s) 13 should never be placed below the level of the upper part 33 of its respective main chamber 12.

b) External shape of secondary chambers 13, which is determined by the part of the body to be supported by its corresponding main chamber 12. A horizontal elongated cross section shape 34 provides a soft or smooth support, ideal for the head and nape 14, lumbar area 16, legs 18–19, calves 20–21 and heels 22; the cross section 35 formed by a horizontal elongated base with a trapezoid shape on top provides a support starting out soft smooth and then little by little becomes steady and firm. This is ideal for the buttocks 17 and for the back 15. The "L" shape 36 for a support going from an initial soft and then quickly from soft to firm, this being ideal for the arm 23 and hand 24 areas. Other shapes can also be used.

c) Density of liquid 26 contained in main chambers 12 and in free flow ducts 30 influence flotation and also the reaction time for the flow of the liquid 26 towards the secondary chambers 13.

In addition to the supporting elements already mentioned, and specifically, but not exclusively, for the arms 23 and hands 24 supporting areas, this invention includes below the base of the main chambers, an elastic body 37, i.e., foam, gel. This is in order to assure maximum support effect when the user presses down on them as an aid in getting up, thus maximizing pressure at these points.

This invention also counts with protection mechanisms, one formed by a tray 38 and the other by an electronic device 39 to monitor leakage that, detecting the presence of leaking liquids will close a normally open circuit and emit a warning sound.

The tray 38, made of a waterproof material, is slightly inclined and is placed in the lower part of the furniture piece. Its function is to retain the leakage or filtration within the piece of furniture, thus avoiding further spillage.

As shown in the FIG. 7, inside this tray 38 at the lowest part 40, there is an electronic device 39 that, detecting the presence of leaking liquids will close a normally open circuit and emit a warning sound.

Tapestry, slipcover, or another similar material covers the outside 41 of not only the structure 10, but also of the chambers fastened to it, in order to give the seating means an aesthetically appealing appearance. This outside cover 41 has zippers and other means, which allow for its removal and for the chambers to be cleaned, filled and/or otherwise maintained as needed.

Figure 10:
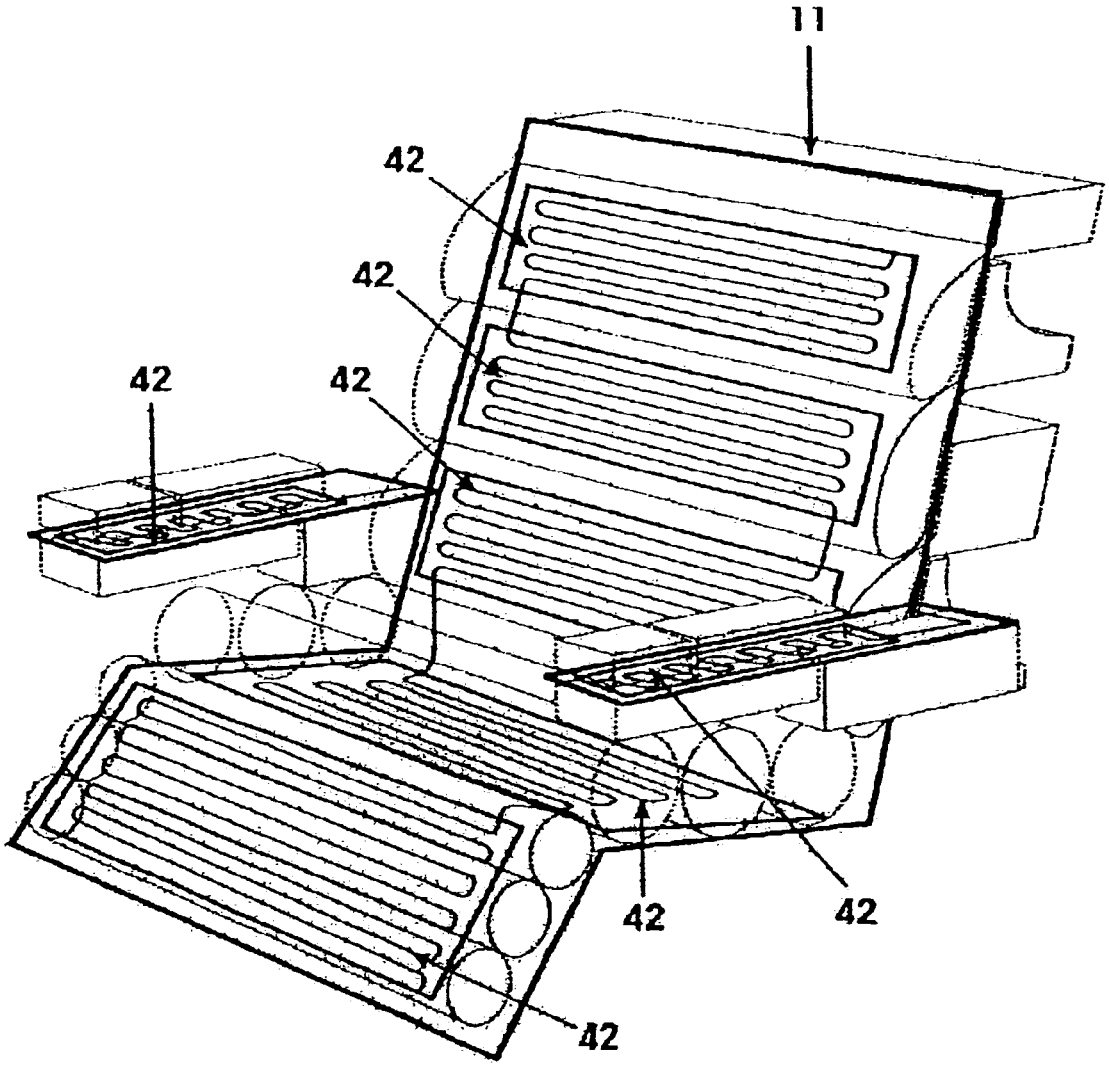
FIG. 10 is a view of the regulation devices for temperature control of a seating means.

As seen in FIG. 10, this invention includes devices to regulate the temperature 42 of the contained liquid formed by an electric fully grounded and insulated liquid proof heating coil with thermostat setting, similar to those used in waterbeds.

It is understood that, many modifications can be made without departing form the spirit of the present invention. The present embodiments are, therefore, to be considered as illustrative and not restrictive, and all changes coming within the meaning and equivalency range of the appended Claims are intended to be embraced therein.

What is claimed is:

1. A seating means with pressure and flotation control made up of a furniture structure with a plurality of support units each arranged at a respective horizontal position, wherein each support unit comprises two kinds of separate chambers:

one main chamber filled with liquid and adapted to support a specific area of the human body, providing an individual control of pressure and flotation for said specific area;

at least one secondary chamber, collapsible, made of waterproof material, initially empty, and connected for liquid interchange with said main chamber via a free flow duct incorporating a valve; and a rigid external body of predetermined shape and size, at least partially surrounding said at least one collapsible secondary chamber to hold said secondary chamber and modulate its way of filling, said rigid body being interposed between a user and said at least one secondary chamber.

2. A seating means with pressure and flotation control, according to claim 1 wherein a total volume of liquid contained in the main chambers and free flow ducts is selected to weigh at least 150% of the maximum weight of an intended user.

3. A seating means with pressure and flotation control according with claim 1, wherein the main chambers are made of a flexible, extensible and elastic waterproof material whose shape and size is determined by an estimated weight of the area of the human body to be supported, considering that each one of the plurality of main chambers of the support units is adapted to support a respective specific part of the human body.

4. A seating means with pressure and flotation control, according to claim 1, wherein the furniture structure with a plurality of support units, each one with two kinds of separate chambers, has a protection mechanism against leakage of the liquid contained in the chambers which is formed by a tray made of a waterproof material and an electronic device monitoring leakage with a warning sound.

5. A seating means with pressure and flotation control, according to claim 1, wherein support units of specific support areas for the arms and hands include additional support elements made of an elastic body, below the base of the corresponding main chamber.

6. A seating means with pressure and flotation control comprising:

a plurality of support units, each support unit having a flexible main chamber and at least one initially empty secondary chamber connected for liquid interchange with said main chamber;

a rigid external body which interposes between a user and said at least one secondary chamber;

wherein said flexible main chambers come into contact with the body of the user, receiving the user's weight, pushing through the free flow ducts towards their respective secondary chamber(s), which secondary chambers never touch the user's body, a volume of liquid equal to the volume displaced by the weight they have received and wherein, when the user gets up, the liquid moved to the secondary chamber(s) returns by gravity to the main chambers;

a tray arranged underneath said flexible chambers and adapted to receive any liquid leaking therefrom; and an electronic monitoring device which emits a warning upon detecting leaking of liquid.

7. A seating means with pressure and flotation control formed by a plurality of support units each made up of two kinds of separate chambers: a main chamber and at least one secondary chamber connected for liquid interchange with said main chamber, wherein respective sequences of pressures at an interface between the user and the seating means, from an initial pressure at first contact of the user with said support unit until a final pressure during resting or flotation are individually controlled in each support unit by three parameters:

(a) relative elevation of the secondary chamber(s) with respect to the respective main chambers, (b) a cross-sectional shape and size of secondary chambers and (c) density of the liquid contained in the main chambers and in free flow ducts, and wherein each secondary chamber has a vertical cross-sectional shape, depending upon a desired pressure sequence, selected from the group consisting of:

an elongated shape which provides a soft support profiles; a shape with an elongated base topped by a trapezoid to provide a profile starting out soft and becoming firmer; a vertically elongated form to provide a continuously firm profile, and a generally L-shaped form, to provide support which is initially soft but then transitions to firm.

8. A seating means with pressure and flotation control according to claim 7, wherein one control parameter of the pressure and flotation is the relative elevation of said secondary chamber(s) with respect to the respective main chamber, and wherein, in an operative orientation, a lowermost part of each secondary chamber is elevated with respect to the top part of the corresponding main chamber connected thereto.

* * * * *